US005499787A

United States Patent [19]

Bonomo

[11] Patent Number: 5,499,787

[45] Date of Patent: Mar. 19, 1996

[54] COLLAPSIBLE HOLDER FOR THIN PLASTIC BAG UTILIZING NON-SLIP TIGHTENING MEANS

[76] Inventor: Melvin E. Bonomo, 6483 SW. 107th Pl., Ocala, Fla. 34476-4811

[21] Appl. No.: 243,159

[22] Filed: May 16, 1994

[51] Int. Cl.[6] ..... A63B 55/04

[52] U.S. Cl. ..... 248/97; 248/188

[58] Field of Search ..... 248/95, 97, 99, 248/100, 101, 188; 220/404; 24/30.5, 284, 324

[56] References Cited

U.S. PATENT DOCUMENTS

| | | | |
|---|---|---|---|
| 1,157,138 | 10/1915 | Wunder | 248/99 |
| 1,362,517 | 12/1920 | Stuart et al. | 24/481 |
| 3,077,020 | 2/1963 | Shears | 24/324 |
| 3,883,104 | 5/1975 | Delafield | 248/188 |
| 4,488,697 | 12/1984 | Garvey | 248/101 |
| 4,899,967 | 2/1990 | Johnson | 248/97 |
| 4,901,959 | 2/1990 | Stage | 248/97 |

*Primary Examiner*—Ramon O. Ramirez
*Attorney, Agent, or Firm*—Julian C. Renfro

[57] ABSTRACT

A bag holder for supporting an open-ended bag of flexible material in position for filling, comprising a plurality of separate segments configured to be releasably joined together to form a ring member having an external, bag contacting surface. Legs are provided for supporting the ring member in a substantially horizontal attitude slightly above ground level. Each of the separate segments constituting the ring member is essentially flat and of elongate, slightly curved construction, with each segment having first and second ends equipped with joinder devices that are able to be readily interfitted. The first end of a first segment is joinable with the second end of a second segment, and the first end of the second segment is joinable with the second end of a third segment, with such joinder of first and second ends of the segments continuing until the completed ring member of sturdy construction is defined. Advantageously, the completed ring member presents an external surface that slopes outwardly and downwardly, over which external surface the open end of the flexible bag can be extended. A suitable tension-applying device surrounds the external surface of the ring member for holding the flexible bag in a tight, non-slip relationship to the external surface of the ring member. Because the segments are releasably joined together, they can be readily separated after use, and stored in a flat container.

31 Claims, 5 Drawing Sheets

COLLAPSIBLE HOLDER FOR THIN PLASTIC BAG UTILIZING NON-SLIP TIGHTENING MEANS

FIELD OF THE INVENTION

This invention relates to a device for supporting a receptacle for receiving a wide variety of objects or items, and more particularly, this invention relates to a device having a ring-shaped member presenting a sloped sidewall for contacting and supporting a receptacle such as a plastic bag in an upright manner, and in a position for easy access for the deposit of leaves, soiled linens and the like. This invention also involves the use of a novel tensioning member utilized for holding the plastic bag tightly in a non-slip manner against the sloped sidewall of the ring-shaped member.

RELATIONSHIP TO OTHER INVENTION

This invention bears a distinct relationship to my invention entitled "SELF-LOCKING TENSIONING BAR," filed on May 16, 1984, Ser. No. 08/243,269, now U.S. Pat. No. 5,421,066 issued Jun. 6, 1995.

BACKGROUND OF THE INVENTION

In recent years, it has become commonplace to use plastic receptacles for receiving leaves, trash, rubbish and soiled linens. These plastic receptacles are often in the nature of bags which are inexpensive, and when full may be disposed of with little expense. Most commonly, such plastic bags are used independently of any other device, and are simply filled with the trash, garbage or the like and then tied shut and discarded.

In other use, these bags may be inserted into a rigid or semi-rigid trash container, much like a liner, and the top of the bag is turned down over the top of the container to hold the bag open and in place in the container. Trash, soiled linens and other such materials are then simply placed into the bag inside the container, and when the bag is full, it is removed from the container, tied and dealt with in an appropriate manner. However, bags utilized in this manner are seldom filled to capacity, and have a tendency to fall back into the container during the fill procedure.

The Kelson U.S. Pat. No. 4,413,800 entitled "Trash Bag Caddy" which issued Nov. 8, 1983 discloses a rigid hoop and rod base for holding a flexible trash bag in an open position for receiving leaves, trash, debris and the like. This arrangement, however, involves a relatively expensive device entirely incapable of being shipped in a small container if for no reason other than the ring or hoop 11 is of one-piece construction.

The Garvey U.S. Pat. No. 4,488,697 entitled "Bag Holder" which issued Dec. 18, 1984 likewise involves an arrangement for holding a thin plastic trash bag in an open position for the receipt of leaves or the like, but this device necessitates the use of several large circular members including an outwardly flared flange, a gasket and an upper retaining ring. Obviously these components are of substantial diameter, and quite unfortunately, they cannot be readily disassembled and shipped in a small, flat container.

The Johnson U.S. Pat. No. 4,899,967 entitled "Portable Flexible Bag Holder" which issued Feb. 13, 1990 is capable of being broken down into circular components of lesser size, but this patent is of obviously expensive construction and requires the use of external clamps for holding the thin plastic bag to the supporting rings.

The Brooks U.S. Pat. No. 5,183,226 entitled "Universal Collapsible Bag Support Stand" which issued Feb. 2, 1993 represents a bag holder of a collapsible design that is capable of being stored in a relatively small volume, but it does not feature any highly effective means for clamping the entire periphery of the open end of a thin plastic bag in a tight, non-slip manner.

It is in an effort to improve upon these and other prior art devices that the present invention was evolved.

SUMMARY OF THE INVENTION

The bag holder in accordance with this invention is intended for supporting an open-ended bag of flexible material, such as of relatively thin plastic, in a convenient position for filling, and advantageously utilizes a ring-shaped member made up of flat segments or sectors that can be readily assembled together, without the use of any tools, to form a highly effective bag-supporting surface that slopes outwardly and downwardly. After use, the segments can be disassembled, so that this novel bag holder can be stored in a comparatively small volume.

Means are provided for supporting the ring member in a substantially horizontal attitude slightly above ground level, which means can take the form of a plurality of legs provided for installation at approximately equal intervals around the lower periphery of the ring member, so that this member can be supported in a desired manner slightly above ground level. Quite importantly, each of the separate segments constituting the ring-shaped member is essentially flat and of elongate, slightly curved construction. Each of these segments has first and second ends, each equipped with joinder means, with the first end of a first segment being joinable with the second end of a second segment, and the first end of the second segment being joinable with the second end of a third segment, with such joinder of first and second ends of these segments continuing until the complete ring is defined. Most advantageously, the completed ring presents an externally directed bag-contacting surface that slopes outwardly and downwardly, with an encircling abutment or bead extending substantially entirely around the upper edge of the sloping surface. It is over this downwardly sloping surface that the open end of a flexible bag can be extended, and novel tension means thereafter caused to surround the external surface of the ring-shaped member, to hold the flexible bag tightly to the encircling abutment or bead disposed around the upper portion of this member. After use, the segments can be readily disassembled for storage.

The segments each have long upper and lower curved sides, with the first or upper curved side being shorter than the second or lower curved side. The first curved side of each segment has an enlarged edge, whereby upon the segments being joined together into a ring-shaped member, the first curved sides of these segments form the aforementioned enlarged peripheral portion against which the tension means can abut, in order to tightly grip the open edge of the flexible bag.

The tensioning means utilized with my novel bag holder may involve a cord in which a tension spring has been interposed, with the action of the cord serving to prevent slippage of the open upper edge of the flexible bag away from contact with the ring-shaped member. However, I may also utilize as the tensioning means, a novel self-locking tensioning bar usable for tightening a cord utilized to encircle the ring-shaped member made up of the separate curved segments. The tensioning bar, which forms the subject of my above-identified co-pending patent application entitled "SELF-LOCKING TENSIONING BAR" is elongate and substantially of rectangular configuration, and has a longitudinally disposed slot in one end. A pair of holes are located adjacent the slot, with a first of the cord-receiving holes being located near the outer end of the slot, and the second of the cord-receiving holes being located comparatively remote from the end of the tensioning bar. One end of the cord extends from the first cord-receiving hole, then around a large object, such as the sloped external surface formed by the curved segments, and thence back through the second cord-receiving hole, while the tensioning bar is residing in a substantially perpendicular relationship to the mounting surface. The cord is then being brought to an initial degree of tension, preparatory to the step of finally tensioning the cord. The tensioning bar, upon being bent from the perpendicular relationship to the mounting surface into a position flat against the large object, causes the cord to be brought into a final degree of tension around the object, and then locked.

As to the construction of the novel segments, the first end of each segment may involve a tang, and the second end of each segment may involve a tang-receiving slot, with the tangs and slots, when interfitted together, causing the segments to form a sturdy ring member. These tangs and slots are advantageously disposed on what may be regarded as the rear sides of the segments, which are on the opposite side of segments from the surface that slopes outwardly and downwardly, thereby preventing a thin plastic bag used with my bag holder being torn by contact with a tang member.

The tang and slot arrangement may be supplemented by the use of a spaced pair of holes utilized in the immediate vicinity of the tangs, and a spaced pair of studs utilized in the immediate vicinity of the tang-receiving slots, with the spacing of each pair of holes and the spacing of each pair of slots being identical, such that the studs and holes may be locked together after the tangs and slots have been interfitted.

Other aspects of this invention involve the use of a number of different leg arrangements, for supporting my novel bag holder.

It is thus to be seen that a primary object of my invention is to provide a novel bag holder for effectively supporting the open end of a bag in a position for easy filling, which bag holder is inexpensive to manufacture, and after use, is able to be collapsed into a small volume.

It is another object of my invention to provide a novel bag holder or stand utilizing a plurality of curved, interfitting segments that are initially flat, but which can be assembled into a ring-shaped member presenting a highly advantageous surface against which the open end of a comparatively thin, flexible bag can be tightly held.

It is yet another object of my invention to provide a novel bag holder utilizing a number of curved, flat segments having joinder means at each end, which segments are capable of being stored in a flat container when not in use, but which are readily able to be joined together to form a ring-shaped member presenting a surface sloping outwardly and downwardly, which surface is ideal for being contacted by the open end of a comparatively thin flexible bag, which bag end is held to the sloping surface in a firm, non-slip manner by the use of suitable tensioning means.

It is yet still another object of my invention to provide a highly effective bag holder for supporting the open upper edge of a thin plastic bag in a non-slip manner, which bag holder can be created by the use of essentially flat segments that are able to be assembled together to form a ring-shaped bag-supporting member, accomplished rapidly and without the use of tools.

It is yet still another object of my invention to provide a novel tension-applying means for encompassing a ring-shaped member, to hold the open end of a flexible bag tightly against an abutment extending around the upper edge of such ring-shaped member.

It is yet still another object of my invention to provide a collapsible bag holder usable with the novel tensioning means set forth in my co-pending patent application entitled "SELF-LOCKING TENSIONING BAR," which application involves the utilization of a self-locking tensioning bar with which a cord is operatively associated, the cord being able to be brought into a condition of initial tension around the open end of a flexible bag, followed by the cord being brought into a condition of substantial tension as a result of the tensioning bar being moved from a first to a second position, thus to achieve an effective locking of the cord in a condition of substantial tension around the open bag end.

It is yet still another object of my invention to provide a collapsible bag holder utilizing a plurality of legs extending outward for reasons of stability, with at least three different leg attachment means able to be utilized with my novel bag holder.

It is yet still another object of my invention to provide a novel collapsible bag holder that can be readily assembled into a sturdy ring that is highly effective for bag support, and that after use can be disassembled and packaged in a minimum space, thus enabling this novel bag holder to be readily stored.

These and other objects, features and advantages will become more apparent as the description proceeds.

DETAILED DESCRIPTION

Figure 1:
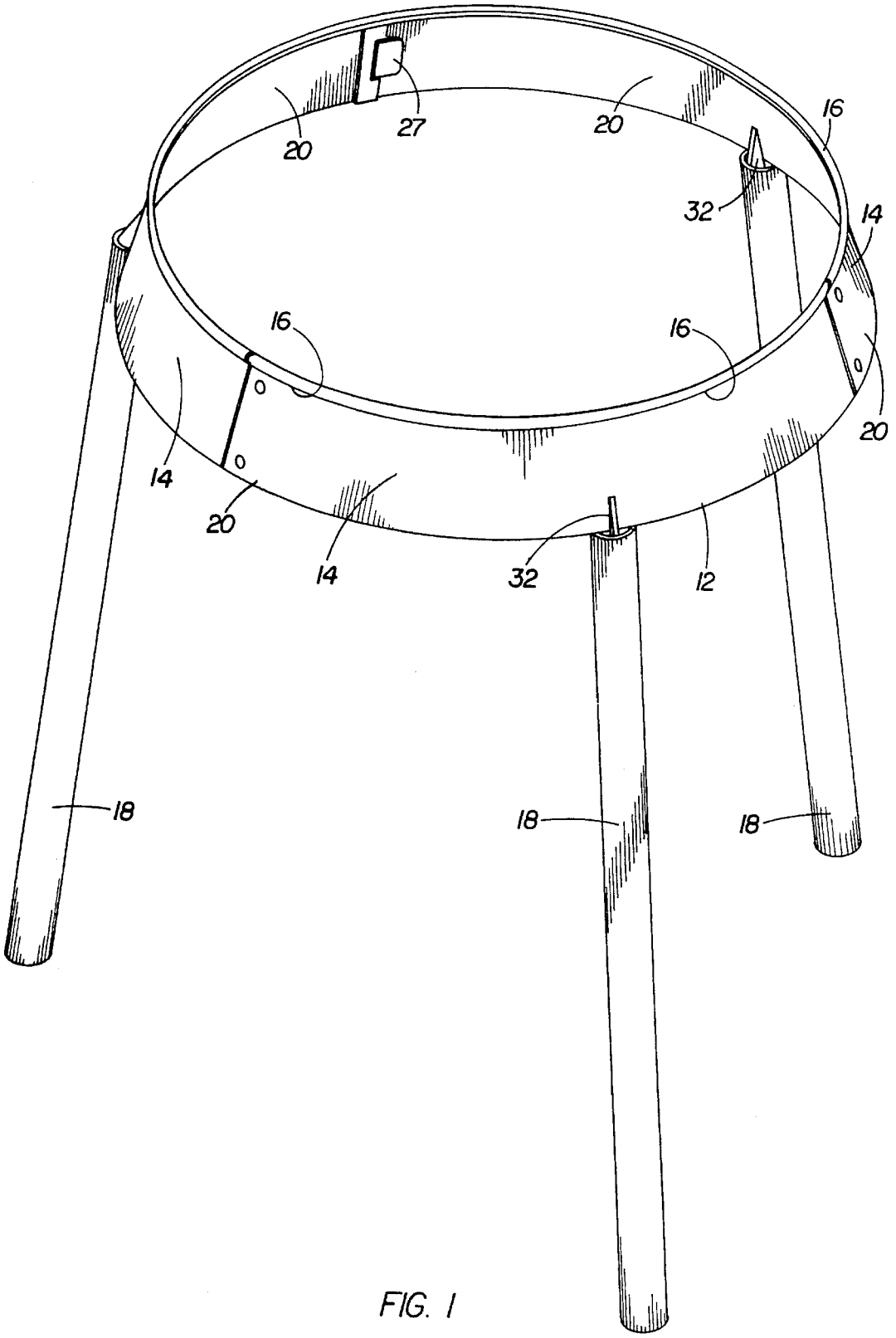
FIG. 1 is a perspective view of a typical bag-supporting stand or holder in accordance with this invention, involving a ring-shaped member presenting an angled surface intended to be contacted by the upper open edges of a thin plastic bag or the like, with a lower portion of such angled surface having means upon which outwardly extending legs can be supported.

With initial reference to FIG. 1, it will there be seen that I have provided a bag holder device or stand 10 in accordance with this invention, with this device comprising a ring-shaped member 12 utilized in conjunction with means for supporting the ring member in a substantially horizontal attitude slightly above ground level. This means for supporting the ring member may take the form of a plurality of legs 18, in this instance three legs.

It will also be seen from FIG. 1 that the ring-shaped member 12 is made up of a plurality of substantially identical curved segments or sector members 20 that have been releasably joined together, and in the present instance, the bag holder device is made up of three such segments or members 20. Although these segments 20 are basically flat and able to be carried or stored in a flat container, these segments are capable of being joined so as to create a sturdy ring ideal for the support of a thin plastic bag, such as of the type utilized for receiving leaves, yard trash, soiled linens or the like. This arrangement is quite advantageous over the prior art arrangements that utilize a one-piece ring-shaped bag-supporting member, inasmuch as the shipping and storage of such a member is obviously burdensome.

Figure 3:
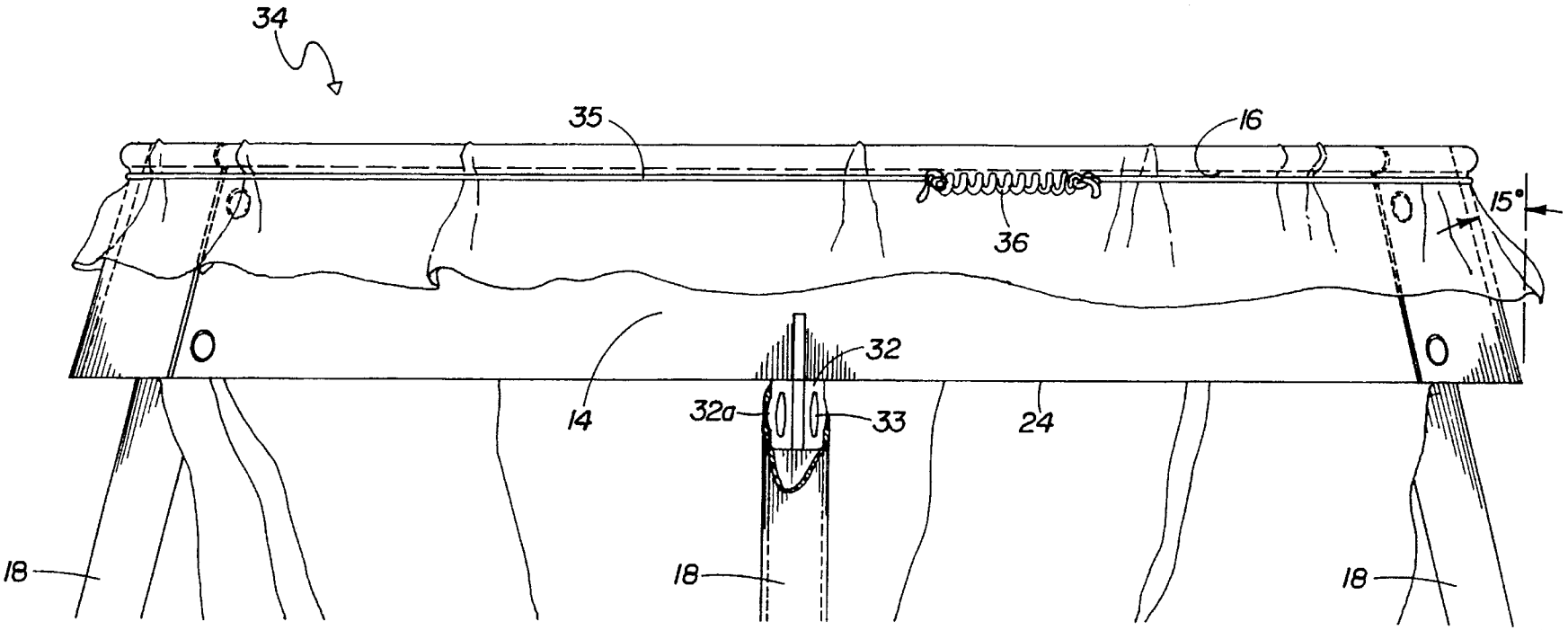
FIG. 3 is a view involving a plurality of segments that have been interfitted in a highly advantageous manner in accordance with this invention so as to present an outwardly and downwardly sloping surface particularly adapted for being contacted by the open upper edge of a thin plastic bag, with this view revealing the preferred angularity of the bag-contacting sloping surface, and also illustrating the location of one type of tension-applying member intended to hold the open edge of the plastic bag in a non-slip manner against a bead extending around the upper peripheral edges of the segments.

I preferably configure the segments so that when joined together, they form a novel external surface 14 that slopes outwardly and downwardly in the manner clearly illustrated in FIGS. 1 and 3, with such surface 14 being ideal for contact by the open edge of a thin plastic bag or the like. Upon the lowermost portions of the segments, appropriate supporting means are attached.

As previously mentioned, the downwardly sloping external surface 14 is intended to be contacted by the upper open edge of a thin flexible plastic bag, typically of the type used to receive leaves, soiled linens, and the like. As will be explained in some detail hereinafter, novel means are provided in accordance with this invention for holding the upper edge of the plastic bag in tight contact with an upper portion of the downwardly sloping surface 14. FIG. 1 reveals that the legs 18 extend a bit outwardly from a vertical centerline (not shown) extending through the center of the ring-shaped or band-shaped member 12. The outwardly extending legs provide more stability to this bag holder or stand than would be possible if the legs were vertically disposed. The legs 18 need not be of any particular length, although it is preferable for the leg length to be such that the bottom of a thin plastic bag, after it has been substantially filled, will make some contact with the ground.

It is important to note in FIGS. 1 and 3 as well as in certain other figures that a substantially continuous bead or abutment 16 extends around the upper edge of the ring member 12, in effect forming an intrinsic part of the downwardly sloping bag-contacting surface 14. This bead or rib is provided for a significant purpose, described at length hereinafter.

It is to be understood from FIGS. 1 and 3 that the ring-shaped member 12 is made up of a plurality of substantially identical curved segments or sector members 20 that have been releasably joined together, and in the present instance, the bag holder device is made up of three such segments or members 20. A typical segment is presented in its normal flat condition in FIG. 2, and it will be seen to have a long upper edge 22 and a somewhat longer lower edge 24. Joinder means are provided at each end of each segment so that a plurality of segments can be readily joined together, with no tools of any kind being required. Further details of the typical segment will be described shortly. Depending on the particular application, the number of segments or members utilized to constitute the ring member that defines the downwardly sloped surface 14 could be as small as two, or as large as four or more.

It is one of the important design features of this invention to provide a bag holder that on the one hand utilizes a sturdy bag-supporting ring member, but that on the other hand can be readily disassembled into a minimal number of components, which components, most advantageously, may be easily packaged in an elongate flat container. Each of the curved segments 20 is typically made of lexan or another tough industrial grade plastic, although I am not to be limited to this material, and in some instances, the segments may be made of a thin metal, such as aluminum.

Figure 2:
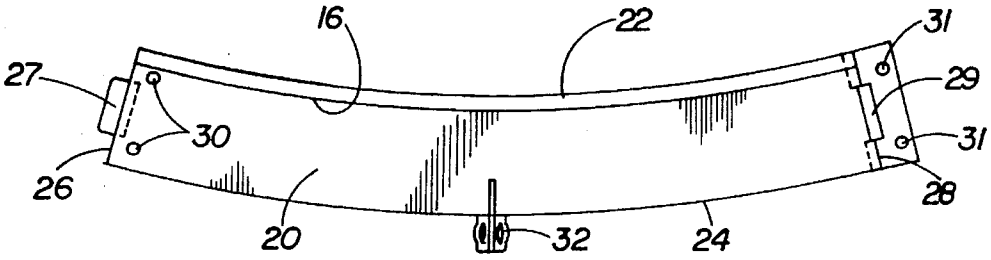
FIG. 2 is a view of a typical flat segment of the type to be interfitted with a plurality of other such segments to form, in accordance with this invention, the novel outwardly and downwardly sloping surface intended to receive the open upper edge of a bag.
Figure 4A:
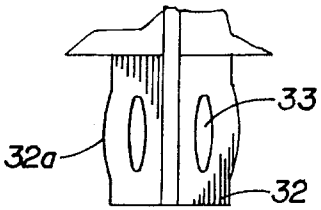
FIG. 4*a* is a fragmentary view to a large scale, of a preferred form of leg supporting means, with this view revealing the arrangement usable for producing a desirable frictional relationship between the leg supporting means and the upper end of the leg.
Figure 4:
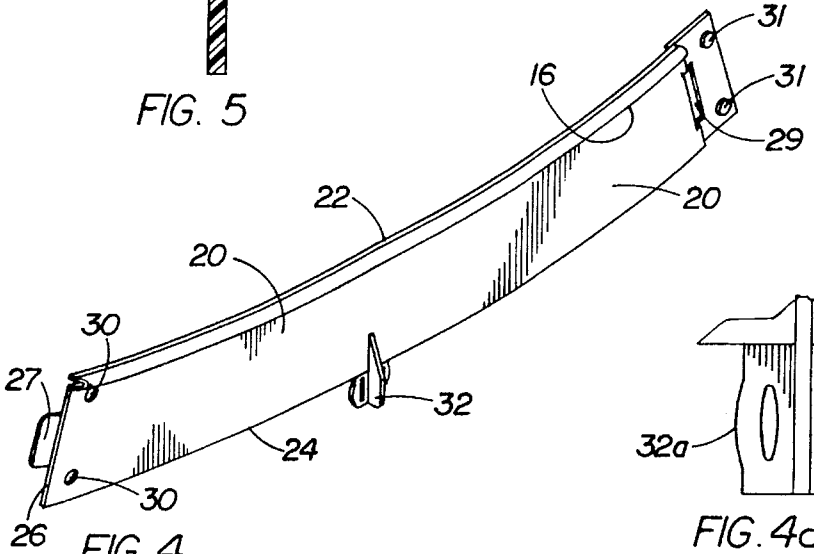
FIG. 4 is a perspective view of a typical novel segment in accordance with this invention, with this view revealing the joinder means utilized on each end of each segment, the locking means I may utilize for holding the segments together, as well as the plus-shaped member I preferably utilize on the lower edge of each segment, for supporting a respective leg.

With regard to the view of a typical, substantially flat segment 20 that I have depicted in FIGS. 2 and 4, it is to be carefully understood that although the long upper edge 22 and the long lower edge 24 of each segment have a distinct amount of curvature, the segments themselves are entirely flat until they are assembled together to form the ring-shaped member 12 and its downwardly sloping surface 14. It is to the long lower edge 24 of the segment 20 that a leg supporting means 32 is secured.

In the primary embodiment, the leg supporting means 32 is configured to receive the open upper end of a leg 18, and in FIGS. 2 through 4 I reveal a preferred form of leg-supporting means 32, which is of plus-shaped (+) configuration. Several optional arrangements for attachment of the supporting legs will be discussed hereinafter.

Fragmentary FIG. 4*a* reveals that the leg-supporting means 32 may have somewhat bulged portions 32*a* on opposite sides, so as to present a desirable amount of friction to the open upper end of a leg to be inserted thereover. I have found that by providing a slot 33 adjacent a bulged portion 32*a*, a highly satisfactory, springy-type action is made available, such that the leg inserted thereover will not fall off should the bag-supporting stand be moved from one location to another. However, with a slight to moderate amount of force, the leg can be readily removed from the device 32 at such time as the bag-supporting stand is being disassembled.

Formed along the long upper edge 22 of each segment is the aforementioned bead or rib 16, with the bead of the several individual curved segments together forming the substantially continuous bead visible in FIG. 1 as extending entirely around the upper circumferential edge of the ring member 12. As will be obvious to those skilled in the art, the uppermost portion of the thin plastic bag rests on the uppermost edge of the bead or rib 16 during the time the bag is being filled. As will be seen hereinafter, the bead or abutment 16 serves an important function in conjunction with the tensioning means I utilize for holding the plastic bag in a non-slip relationship to the downwardly sloped surface 14.

Continuing with FIG. 2, it will be seen from this exemplary version of one of my novel segments that each curved segment 20 has first and second ends, with the first or male end 26 having an outwardly-extending tang or tab-shaped member 27, and the second or female end 28 having a tang-receiving or tab-receiving slot 29. For a reason to be apparent shortly, each tang 27 is affixed to its respective segment in an offset manner, meaning that the tang 27 resides somewhat out of (below) the principal plane of the segment. This arrangement is made clear from FIG. 6. Each tang 27 of each segment 20 is intended to interact with the second or female end 28 of the adjacent segment, and more particularly, each tang 27 is intended to be inserted into the slot 29 formed in the female fitting 28. It is to be noted that each tang-receiving slot 29 of each curved segment 20 is carefully configured to receive the offset tang or male fitting 27 of the adjacent curved segment and still have the outer surface of the segment reside in a flat or aligned relationship to the adjacent segment.

Figure 6:
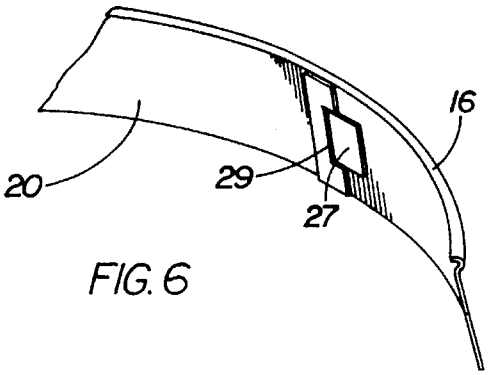
FIG. 6 is a fragmentary view illustrating the male and female fittings preferably utilized for joining the end of one segment to the end of the adjacent segment, with such fittings being located on the interior sides of the individual segments and with the joinder of the segments being accomplished in such a manner as to provide an uninterrupted outer surface to be contacted by the upper edge of the thin plastic bag.

It should now be clear that the construction I prefer involves the tang and slot each being offset from the plane of the segment to which they are attached, or in other words, are on the backside of the segments; see FIG. 6. Therefore, it can be expected that the outer surface of the several interconnected segments 20 will form a downwardly and outwardly sloping surface 14 that is smooth, as indicated from FIGS. 1 and 3, and be quite unlikely to tear the upper edges of a flexible plastic bag coming in contact with the surface 14.

I may supplement the use of the tangs and tang-receiving slots by the use of a spaced pair of holes 30 in the immediate vicinity of the tang of each segment, and a spaced pair of studs 31 in the immediate vicinity of the tang-receiving slot of each segment, with the spacing of the holes and the studs being substantially identical. The studs 31 are most clearly seen in FIG. 4. Because of this arrangement, after the tangs and slots have been interfitted, the studs 31 and respective holes 30 may be locked together. After use, the interfitted segments may be readily disassembled for storage.

It should now be clear that each of the plurality of segments 20 I utilize for forming the ring member of my advantageous bag holder are of substantially identical construction, with the first end of a first segment being joinable with the second end of a second member, and the first end of the second member being joinable with the second end of a third curved segment. This joinder of first and second ends of the curved segments continues until a complete, sturdy ring of a preferred size has been defined. I have found through experience that three curved segments are usually desired, but if particularly long curved segments are used, only two such segments need to be utilized. However, longer segments obviously require a longer box or carton for the packaging thereof. On the other hand, if particularly short segments are used, my novel bag holder device may be comprised of four or more curved segments.

Because the upper long edge 22 and the lower long edge 24 possess curvature, the completed ring member advantageously presents, as previously mentioned, an external surface 14 that slopes outwardly and downwardly, over which external surface the open end of a flexible plastic bag or the like can be extended. One or another type of tension-applying means to be described hereinafter may be utilized in a surrounding relationship to the external surface of the ring-shaped member 12, and against the circumferentially extending rib or abutment 16, to hold the flexible bag in a tight, non-slip relationship to the sloped bag-contacting surface 14. As is obvious, the rib or abutment 16 prevents the tensioning means from passing over the top of the ring-shaped member 12, which would have the undesirable effect of permitting the upper edge of the bag to pull entirely away from the member 12.

Figure 5:
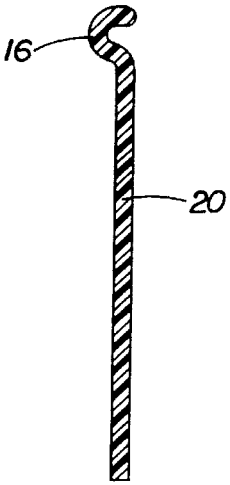
FIG. 5 fragmentary edge view to a large scale of a typical segment, revealing one manner by which the bead or abutment utilized around the upper edge of each segment can be created.

From FIG. 4, and to a greater extent from FIG. 5, it may be seen that the rib or bead 16 need not be of solid material, but rather it can be created by forming a continuous bend or curvature along the upper edge 22 of each curved segment 20.

It is to be understood that I am not to be limited to the bag-contacting external surface 14 having any particular angularity, although I have found that an angularity of 15° is appropriate in most instances; note FIG. 3.

In an exemplary embodiment of my invention in which three segments 20 were utilized, the long upper edge 22 of each segment was formed to have a 35.739" radius, and the somewhat longer lower edge 24 was formed to have a 38.989" radius. A straight line connecting the first and second ends of the segment 20 depicted in FIG. 2 had a length of 19.137". The height of the angled external surface 14, including the bead 16, is approximately 3 ¼ ". The bead preferably protrudes for approximately 3/16" above the plane of the segment; see FIG. 5. Obviously I am not to be limited to these dimensions, and manifestly other embodiments of this invention could be either larger or smaller.

Regarding FIG. 3, it is to be seen in this figure that I have shown multiple segments 20 joined together to form the previously-mentioned downwardly sloped external surface 14 for receiving the open edge of a plastic bag, with the upper edge of these joined segments having the previously-mentioned enlargement I prefer to regard as the bead or rib 16. The bead or rib 16 not only provides a bit of additional strength to each segment, but also it provides a type of abutment against which a tensioning member or tension-applying member 34 used with my device to hold a plastic bag in place can effectively interact and thus retain the upper edges of a plastic bag in a tight, non-slip manner.

With continuing reference to FIG. 3, it is to be seen that a tensioning member 34 may take the form of a cord 35, in one part of which a tension spring 36 is interposed, this spring being utilized for causing the cord 35 to bear tightly against the bead or abutment 16 in the manner to be seen in FIG. 3, thus holding the open upper edge of the plastic bag tightly against the downwardly sloped external surface 14. The bead or rib 16 thus represents a highly effective means for preventing the cord 35 of the tensioning member 34 from moving undesirably away from contact with the angled surface of the segment members, which would have the unfortunate effect of letting drop, the flexible plastic bag whose upper edge has been in contact with the sloped bag-contacting surface 14.

Another form of tensioning member, usually preferred over the cord and spring arrangement shown in FIG. 3, will be described in detail hereinafter in connection with FIG. 11*a* and the figures following. However, the invention entitled "SELF-LOCKING TENSIONING BAR" is separately claimed in my previously-identified co-pending patent application.

It is also to be noted from FIG. 3 that the previously-mentioned leg-supporting means 32 may protrude downwardly from a mid point of the long lower edge 24 of each segment, with the means or member 32 being of a size and configuration such as to form a highly effective support for the open upper end of one of the legs 18. The upper end of the leg is sized such that it may be readily inserted over the means 32, and in order to minimize friction, I prefer for each means 32 to be of plus-shaped (+) cross section, as mentioned previously, and discussed in conjunction with FIG. 4*a*, although this is not mandatory.

Because the surface 14 is angled downwardly and outwardly, this causes each means 32 to support its respective leg in a manner such that the leg extends outwardly from the previously-mentioned imaginary vertical centerline passed through the center point of the fully assembled ring-shaped member 12.

By the following example, it is believed that the 15° angularity I prefer for the outwardly and downwardly sloping external bag-contacting surface 14, otherwise referred to as the angled skirt, can be adequately explained.

Inasmuch as I have found that the plastic leaf bags holding 30 gallons have a circumference of approximately 60", if that circumference is divided by 3.1416, the result is an upper bag edge that is approximately 19 3/32" in diameter. Inasmuch as previously mentioned bead or rib 16 preferably protrudes approximately 3/16" above the plane of the respective segment member, this adds another 3/8" to the diameter of the completed ring-shaped member 12, for an approximate total diameter of 18.875". This is an appropriate diameter in order to form a suitable circumference over which the edge of the plastic leaf bag may extend.

Figure 7:
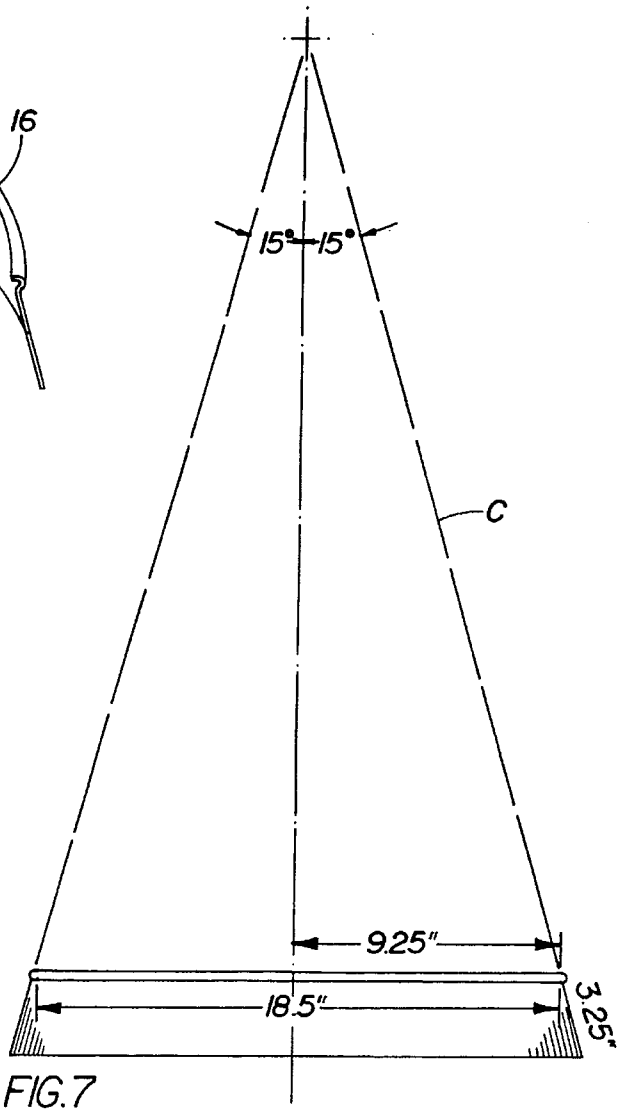
FIG. 7 is a view of a triangle utilized in the calculation of the appropriate angle for the outwardly and downwardly sloped bag-contacting edge of the ring-shaped member.

It will be seen from FIG. 7 that if a relatively large triangle is formed having a base measuring 18.5", and if the upper angle of this large triangle is bisected, then two 15° angles are created. This large triangle may be regarded as representing the cross section of a cone, with the segment across the bottom of the cone representing a frustum of the cone. This 15° has been found to be the appropriate angle at which the bag-contacting surface 14 is disposed.

Figure 8:
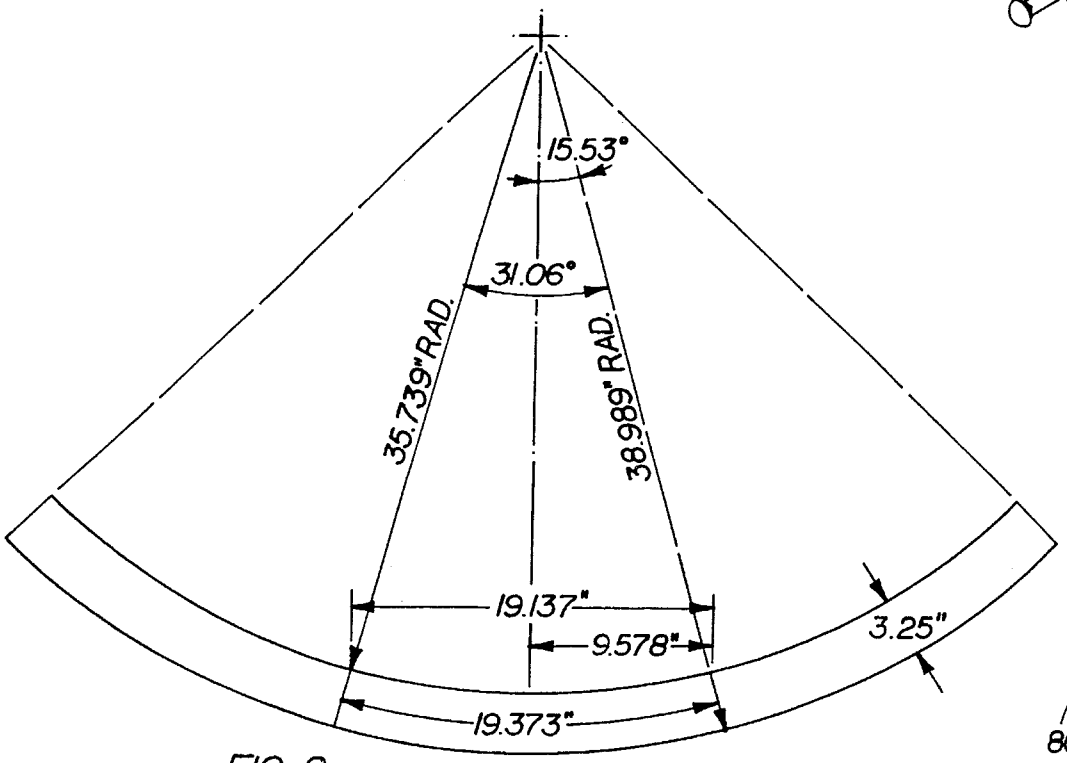
FIG. 8 is a view showing the calculations involved in ascertaining the length of a typical segment to be utilized with other such segments in order to define the sturdy ring whose outer edge is adapted to receive the open edge of a thin plastic bag of a certain gallonage.

Given a base of 9.25" for each lesser triangle illustrated in FIG. 7, and an upper angle of 15°, the length of the side C of this figure can be arrived at by dividing 9.25 by the sine of 15°. This results in the hypotenuse of this side C being of a length of 35.739", as depicted in FIG. 8. In this instance, the length of the segment is 19.137", but when opened out flat, to the position previously depicted in FIG. 2, the length of the segment becomes 19.373".

As should now be clear, by the cone being laid flat as depicted in FIG. 7, it can be seen that three segments, each slightly over 19" in length, are appropriate when a plastic bag having an opening 60" in circumference is to be used therewith. To give a skirt of sufficient width, I prefer for each of the three segments so formed to have a height from 3.25" to 3.5", as previously mentioned, although I prefer a height of 3.25".

From this first example it is to be seen that if a typical cross section of the ring-shaped member 12 is disposed at 15° to the vertical, the legs will extend somewhat outwardly, and provide ample stability for my bag holder. Also it should be noted that if the legs 18 extend somewhat outwardly, away from the imaginary vertical centerline extending through the center of the ring-shaped member, ample space will be provided into which a bag that is filled or even semi-filled can expand, without interference. This would not be the case if the legs were vertically disposed, for then in that instance, the presence of the legs would inhibit the broadening out of the base of the bag.

Figure 9:
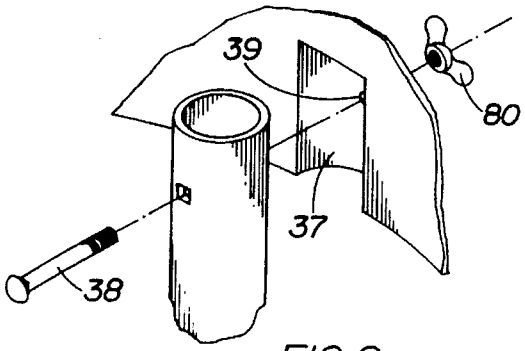
FIG. 9 is an alternative leg-supporting arrangement that may be utilized in the mid portion of each novel segment in accordance with this invention, with a leg-receiving bulge being located in each segment.

With reference now to FIG. 9 it will be seen that I have shown another embodiment of the arrangement utilized for securing the upper ends of the legs to the segments, with this involving a segment whose lower edge contains a bulge or cavity 37 designed to receive the upper end of a leg. So as to prevent the leg from being dislodged from this bulge or cavity, I provide a hole 39 in the bulge or cavity, with a hole of substantially the same size contained in the upper end of the leg to be used therewith. By inserting a bolt 38 through the aligned holes, the respective leg can be secured to the mid part of the lower curved edge of the segment. A suitable wing nut 80 is utilized for threadedly engaging the threads on the bolt 38, to secure the leg tightly in the desired position. The bolt 38 normally stays with the leg.

Figure 10:
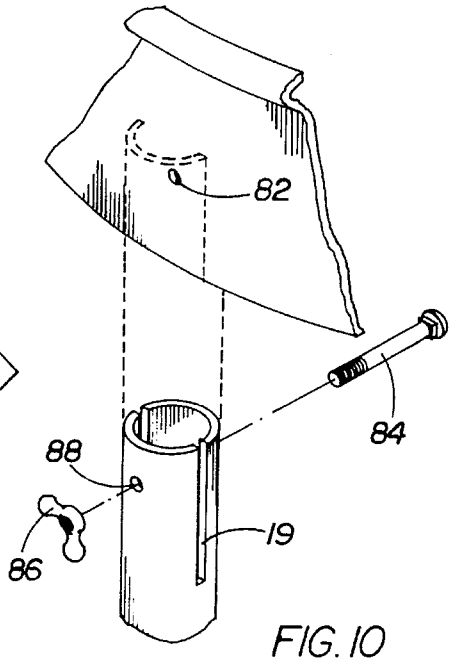
FIG. 10 is still another alternative leg-supporting arrangement, wherein the upper end of each leg is slotted so as to be received and then secured in a mid portion of each novel segment.

In accordance with another embodiment of my invention, I may provide, as shown in FIG. 10, a segment containing a hole 82 in a mid portion of its curved lower edge, with this portion of the curved lower edge being designed to receive the slotted upper end 19 of a leg in which a mounting hole 88 has been created. By placing the slotted upper end 19 of the leg over the edge of the segment in the vicinity of the hole 82, a bolt 84 can be passed through the aligned holes, with a wing nut 86 on the bolt then tightened to firmly lock the leg to the respective segment.

DETAILS OF THE SELF-LOCKING TENSIONING BAR

Figures 11A, 11B, 11C, 12, 13, 14:
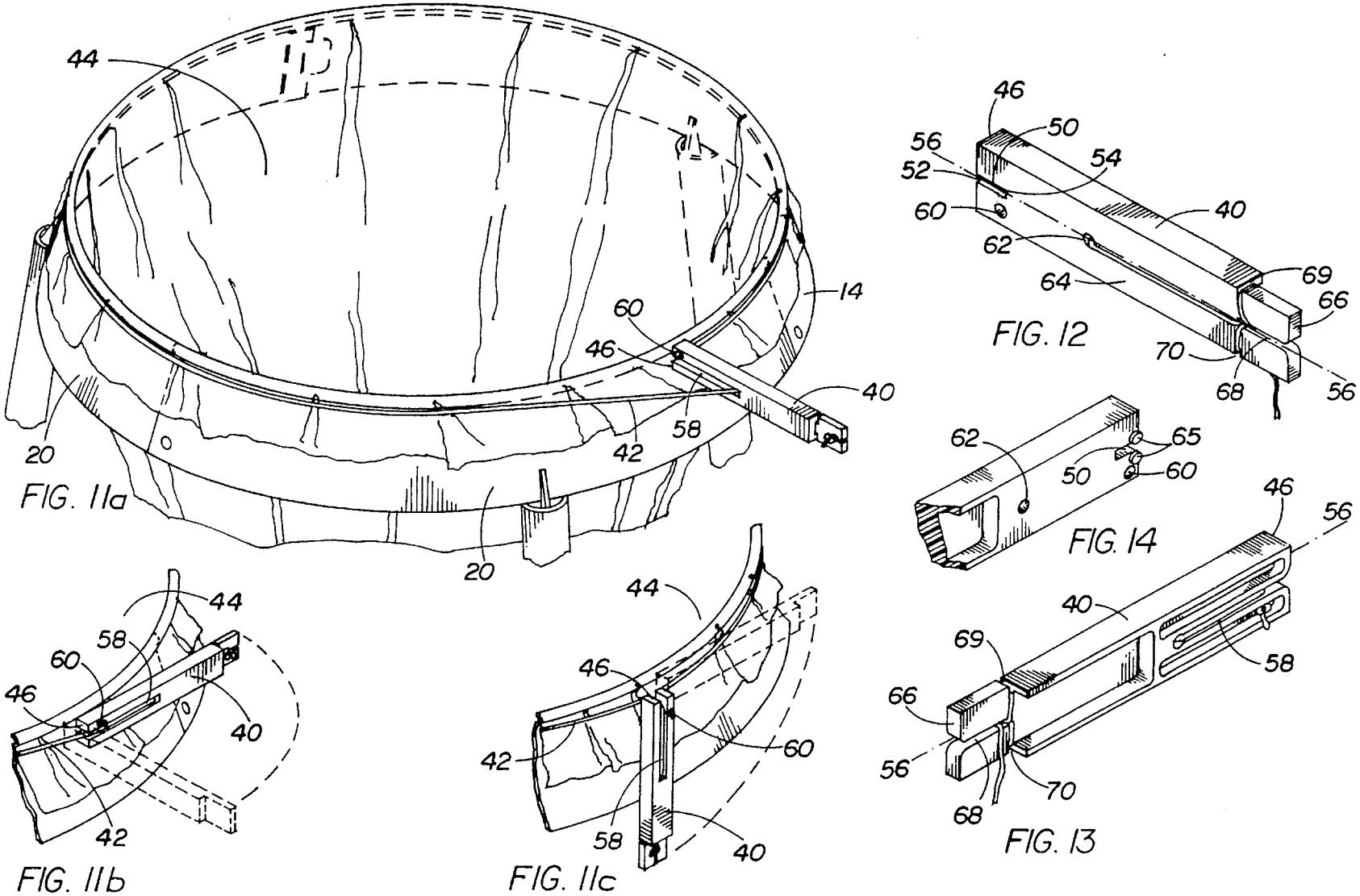
FIG. 11*a* is a perspective view of the upper portion of a bag-supporting stand in accordance with my invention, in operative engagement with which is a novel self-locking tensioning bar of a type preferred for applying substantial tension to the cord encircling the open upper edge of a thin plastic bag, with the tensioning bar being shown in this instance in a first position with respect to the bag-supporting stand.
FIG. 11*b* is a fragmentary view of the upper portion of the bag-supporting stand of FIG. 11*a*, with the tensioning bar being depicted as having been rotated to a second position, with this rotation of the bar causing the cord to tightly engage the bead or abutment extending around the upper edge of the sloped bag-contacting surface.
FIG. 11*c* is a fragmentary view relatable to FIG. 11*b*, but with the tensioning bar having been moved to a locking position in which the bar resides after the tightening procedure has been completed.
FIG. 12 is a perspective view, to a substantially enlarged scale, of the smooth side of my novel self-locking tensioning bar, which is the side of the bar to be brought against the cord as a consequence of the rotation depicted in FIG. 11*b;*
FIG. 13 is a perspective view to approximately the same scale utilized in FIG. 12, but here showing the other or outer side of my novel self-locking tensioning bar, to reveal the elongate, cord-receiving slot that may extend along a portion of this outer side.
FIG. 14 is a fragmentary view of a tensioning bar of modified construction, in which a pair of protruding pins are utilized for cord control, instead of the elongate, cord-receiving slot revealed in FIG. 13.

With reference now to FIGS. 11*a* through 11*c* as well as FIGS. 12 through 14, it will be seen that I have shown a novel tensioning member of a type that is generally preferred over the more basic form of tensioning member depicted in FIG. 3. Depicted in FIG. 11*a* is my novel self-locking tensioning bar 40 usable for tightening a cord 42 in a highly effective manner around an object, such as the large circular object 44 visible in this figure, with this tightening being accomplished by a novel form of self-locking action.

As previously indicated, this self-locking tensioning bar is separately claimed in my co-pending patent application "SELF-LOCKING TENSIONING BAR," and the details of this device are set forth at this time in order to reveal how this device can be utilized with my novel collapsible bag holder forming the subject of the instant invention.

It is of course to be realized that the large circular object 44 can be the previously-described ring member 12 defining the downwardly and outwardly sloping external surface 14, created by interfitting the curved segment members 20 together, but my novel tensioning bar 40 is obviously not limited to use with that particular type of device.

As seen to a larger scale in FIGS. 12 and 13, my novel self-locking tensioning bar 40 is elongate, being of substantially rectangular configuration. The side of the tensioning bar 40 visible in FIG. 12 is preferably smooth, whereas the side of the same bar visible in FIG. 13 is channeled. Importantly, and as best seen in FIG. 12, a longitudinally disposed slot 50 is disposed on the end 46 of the tensioning bar 40, with the slot 50 extending entirely through the bar 40, being located on the longitudinal centerline 56—56 of the tensioning bar.

Readily seen in FIG. 12 is a first cord-receiving hole 60, located near the end 46 of the bar 40, and adjacent the longitudinally disposed slot 50. Also visible in FIG. 12 is a second cord-receiving hole 62, intended to receive the free end of the cord after it has been passed around the large circular object. The hole 62 is located in a mid portion of the bar 40, in a position comparatively remote from the end 46 of the bar 40, but nevertheless closer to the end 46 than to the end 66 of the tensioning bar. The holes 60 and 62 are thus to be seen to be in an offset relationship, and these holes are intended to receive a relatively strong cord, such as will withstand a 70 pound pull, provided for a purpose soon to be described.

In one particular instance, the tensioning bar 40 was made of polypropylene, being approximately three inches long, approximately 9/16" wide, and approximately ¼" thick. However, I obviously am not to be limited to any particular dimension or to any particular constructional material.

From FIG. 12 it will be seen that the longitudinally disposed slot 50 extends for a limited extent along the longitudinal centerline 56—56, and in one prototype, the slot was 0.280" deep, but quite obviously I am not to be limited to this. For a reason soon to become apparent, the width dimension of the slot 50 is very nearly the same as the diameter of the cord 42, and in one particular instance, the slot was 0.070" wide. The slot 50 has an outer end 52 and an inner end 54, with the outer end 52 being spaced just inside the end 46 of the tensioning bar.

In the embodiment of my invention depicted in FIG. 13, an elongate cavity 58 extends along centerline 56—56 from the slot 52 to the immediate vicinity of the second cord-receiving hole 62. The elongate cavity 58 does not extend through to the smooth side of the bar 40, and it is in the cavity 58 that the cord 42 resides during the tightening phase of the operation of my tensioning bar 40, when the side of the tensioning bar that is illustrated in FIG. 13 is brought into contact with the large circular object, in the manner shown in FIG. 11*b*.

In the first cord-receiving hole 60, one end of the cord 42 is to be anchored, such as by tying a knot therein of suitable size. The cord also extends through the second cord-receiving hole 62, but only after passing around the large circular object 44. In other words, a comparatively large loop may be regarded as normally existing in the cord 42 between the first and second cord-receiving holes. The second cord-receiving hole 62 is located on the centerline 56—56 of the tensioning bar 40 at a location that is offset approximately ⅞" away from the first cord-receiving hole 60. However, I am not to be limited to this particular distance.

Returning to FIG. 11*a*, it will be noted in this figure that the cord 42 has been passed around the large object 44 and the tensioning bar 40 has been caused to be disposed in a substantially perpendicular relationship to the object 44. In this instance, the end 46 of the tensioning bar is in contact with the object 44. While the bar 40 is in this substantially perpendicular relationship, the user pulls upon the cord 42 at a location comparatively close to the second cord-receiving hole 62, to bring the cord to an initial degree of tension around the object 44. The end of the cord is then pulled tightly into a tapered slot 68, also referred to as a secondary slot, which is provided at end 66 of the tensioning bar; note FIGS. 12 and 13.

At this point the user proceeds to lock the cord in the tapered slot 68, by first passing the cord into notch 69, for example, thence back into slot 68, and thereafter inserting the cord tightly in notch 70, followed by returning the cord to the slot 68. This arrangement by which the cord is affixed to the end 66 of the bar is generally indicated in FIGS. 12 and 13. As will be readily understood, this procedure serves to tightly anchor the cord 42 with respect to the end of the bar 40 remote from the end 46 in contact with the large object 44.

Having firmly anchored the cord to the bar 40, the user now is ready to bend or rotate the bar from the position shown in FIG. 11*a*, into the position shown in solid lines in FIG. 11*b*, in which the side of the bar depicted in FIG. 12 comes into close contact with a tensioned cord portion and with the large object 44. This movement of the bar 40, which may be regarded as rotation in a counter-clockwise direction as viewed in FIG. 11*a*, has the effect of causing the cord 42 to enter the previously-mentioned elongate cavity 58, in the manner depicted in FIG. 11*b*.

Because of the offset relationship of the first and second cord-receiving holes 60 and 62, this rotative movement of the bar causes the cord 42 to be brought into a substantial degree of tension around the object, but in order to prevent the bar from (undesirably) returning to the outwardly-extending position depicted in dashed lines in FIG. 11*b* should the bar be released, it is then necessary for the bar to be rotated 90° downwardly, into the position shown in FIG. 11*c*. This rotation has the effect of forcing the cord under the bar and into the slot 50, thus bringing about a highly effective locking action. The user may find it convenient to press with the tip of one finger against the tensioned cord 42 at such time as he is endeavoring to bring the bar 40 to the downwardly extending position shown in FIG. 11*c*. The substantial tension now existing in the cord 42 could not be reduced unless this procedure was for some reason reversed.

As an indication of the substantial tension now existing in the cord 42, if while the bar 40 is hanging downwardly in the position depicted in FIG. 11*c*, the user should lift the end 66 somewhat away from the circular object 44, the bar will rotate about the end 46, and should the end 66 then be released, the substantial tension in the cord 42 will cause the bar to snap back into the flat position depicted in FIG. 11*c*.

I am not limited to the use of the elongate cavity 58 depicted in FIG. 13, for as illustrated in FIG. 14, I may utilize a short, outwardly protruding pin 65 on each side of the slot 50. These pins serve to prevent undesirable cord slippage during the time that the bar is being moved from the position shown in full lines in FIG. 11*b*, into the position shown in FIG. 11*c*. In other words, the pins 65 assure the cord residing along the centerline of the bar and having a proper relationship to the second cord-receiving hole 62.

Those familiar with this art will readily understand that my novel self-locking tensioning bar provides a ready means for a person not possessing considerable strength, to place the cord 42 around a circular object to a high degree of tension. Because the tensioning bar is at least 3" long, the user has a considerable amount of mechanical advantage.

Although I prefer for the holes 60 and 62 to be on the order of ⅞" apart, this distance may vary from application to application.

As is obvious, the holes can be further apart than ⅞" for certain larger applications, but if the holes are an inch or more apart, it may be necessary to increase the length of the tensioning bar somewhat, so as to give the user sufficient mechanical advantage to be able to move the tensioning bar from the first to the second position.

I claim:

1. A bag holder for supporting an open-ended bag of flexible material in position for filling, said bag holder comprising a plurality of separate segments configured to be releasably joined together to form a ring member having an external, bag contacting surface sloping outwardly and downwardly, with an upper portion of said sloping surface being the minimum diameter portion of the surface, and means for supporting said ring member in a substantially horizontal attitude slightly above ground level, each of said separate segments constituting said ring member being essentially flat and of elongate, slightly curved construction, each segment having first and second ends, with each end equipped with joinder means able to be readily interfitted, and at a later time separated, with the first end of a first segment being joinable with the second end of a second segment, and the first end of the second segment being joinable with the second end of a third segment, with such joinder of first and second ends of said segments continuing until the completed ring member is defined, which completed ring member presents the external surface that slopes outwardly and downwardly, over which external surface the open end of the flexible bag can be extended, said segments together defining a circumferentially extending abutment adjacent the upper, minimum diameter portion of said sloping external surface, and tension-applying means surrounding said external surface of said ring member for holding the flexible bag tightly to said external surface of said ring member, which tension-applying means may move up said sloping external surface into contact with said circumferentially extending abutment, to hold the flexible bag in a tight, non-slip relationship to the external surface sloping outwardly and downwardly.

2. The bag holder for supporting an open-ended bag of flexible material in position for filling as recited in claim 1 in which said tension-applying means involves a cord in which a tension spring is utilized.

3. The bag holder for supporting an open-ended bag of flexible material in position for filling as recited in claim 1 in which said tension-applying means involves a cord attached to a self-locking tensioning bar, said tensioning bar having a pair of offset cord-receiving holes, said tensioning bar being rotatable approximately 90° by a user at such time as said cord is to be placed in tension.

4. The bag holder for supporting an open-ended bag of flexible material in position for filling as recited in claim 1 in which said joinder means involves a first end of each segment having a tang, and a second end of each segment having a tang-receiving slot, with said tangs and slots, when interfitted together, causing said segments to form a sturdy ring member.

5. The bag holder for supporting an open-ended bag of flexible material in position for filling as recited in claim 4 in which said tang and tang-receiving slots are disposed on the sides of said segments away from said external surface.

6. A bag holder for supporting an open-ended bag of flexible material in position for filling, said bag holder comprising at least three separate segments configured to be releasably joined together to form a ring member having an external, bag contacting surface sloping outwardly and downwardly, and means for supporting said ring member in a substantially horizontal attitude slightly above ground level, each of said separate segments constituting said ring member being essentially flat and of elongate, slightly curved construction, each segment having first and second ends, with each end equipped with joinder means able to be readily interfitted, and at a later time separated, with the first end of a first segment being joinable with the second end of a second segment, and the first end of the second segment being joinable with the second end of a third segment, with such joinder of first and second ends of said segments continuing until the completed ring member is defined, which completed ring member presents the external surface that slopes outwardly and downwardly, over which external surface the open end of the flexible bag can be extended, and tension-applying means surrounding said external surface of said ring member for holding the flexible bag tightly to said external surface of said ring member.

7. The bag holder for supporting an open-ended bag of flexible material in position for filling as recited in claim 6 in which said means for supporting said ring member comprises a plurality of legs of substantially equal length utilized at approximately equal intervals around the lower periphery of said ring member.

8. The bag holder for supporting an open-ended bag of flexible material in position for filling as recited in claim 6 in which each of said segments has a pair of curved sides, with a first curved side being shorter than the second curved side, said first curved side of each segment having an enlarged edge, whereby upon said segments being joined together into a ring member, said first curved sides of said segments form an enlarged peripheral portion extending substantially continuously around said ring member, against which said tension-applying means can abut, in order to tightly grip the open edge of the flexible bag.

9. The bag holder for supporting an open-ended bag of flexible material in position for filling as recited in claim 8 in which said tension-applying means involves a cord in which a tension spring is utilized.

10. The bag holder for supporting an open-ended bag of flexible material in position for filling as recited in claim 8 in which said tension-applying means involves a cord attached to a self-locking tensioning bar, said tensioning bar having a pair of offset cord-receiving holes, said tensioning bar being rotatable approximately 90° by a user at such time as said cord is to be placed in tension.

11. The bag holder for supporting an open-ended bag of flexible material in position for filling as recited in claim 8 in which said joinder means involves a first end of each segment having a tang, and a second end of each segment having a tang-receiving slot, with said tangs and slots, when interfitted together, causing said segments to form a sturdy ring member presenting said external surface sloping outwardly and downwardly.

12. The bag holder for supporting an open-ended bag of flexible material in position for filling as recited in claim 11 in which said tang and tang-receiving slots are disposed on the sides of said segments away from said external surface that slopes outwardly and downwardly, thereby preventing a thin plastic bag used with said bag holder being torn by contact with a tang member.

13. The bag holder for supporting an open-ended bag of flexible material in position for filling as recited in claim 11 in which a spaced pair of holes is utilized in the immediate vicinity of said tangs, and a spaced pair of studs is utilized in the immediate vicinity of said tang-receiving slots, with the spacing of said pair of holes and the spacing of said pair of studs being substantially identical, whereby said studs and said holes may be locked together after the tangs and slots have been interfitted.

14. The bag holder for supporting an open-ended bag of flexible material in position for filling as recited in claim 7 in which a leg supporting means is affixed in approximately the center portion of a lower edge of each of said segments.

15. The bag holder for supporting an open-ended bag of flexible material in position for filling as recited in claim 14 in which each leg supporting means, by virtue of being operatively associated with a surface that slopes outwardly and downwardly, causes the respective leg to extend outwardly from the vertical centerline of said bag holder, thus to increase the stability of said bag holder.

16. The bag holder for supporting an open-ended bag of flexible material in position for filling as recited in claim 14 in which each of said leg supporting means protrudes downwardly in order to receive the open end of one of said legs.

17. The bag holder for supporting an open-ended bag of flexible material in position for filling as recited in claim 14 in which said leg supporting means involves an outward bulge in approximately a mid portion of each segment, with the upper end of a leg being received in each outward bulge.

18. The bag holder for supporting an open-ended bag of flexible material in position for filling as recited in claim 14 in which said leg supporting means includes a hole provided in approximately a mid portion of a lower side of each segment, with the upper end of each leg having a mounting hole as well as being slotted to be inserted upon said lower side of the respective segment, said hole in each segment being in a 90° relationship to the slotted upper end of the respective leg, and securing means passing through the hole in each leg when aligned with the hole in the respective segment, to prevent dislodgment of the respective leg from engagement with said lower side of its segment.

19. A bag holder for supporting an open-ended bag of flexible material in position for filling, said bag holder comprising a ring member constituted by separate segments configured to be releasably joined together to form a sturdy ring member having an external surface sloping outwardly and downwardly, and a plurality of legs for installation at approximately equal intervals around the lower periphery of said ring member, for supporting said ring member in a substantially horizontal attitude slightly above ground level, each of said separate segments constituting said ring member being essentially flat and of elongate, slightly curved construction, each segment having first and second ends, each end equipped with joinder means, with the first end of a first segment being joinable with the second end of a second segment, and the first end of the second segment being joinable with the second end of a third segment, with such joinder of first and second ends of said segments continuing until the completed ring member is defined, which completed ring member presents the external surface that slopes outwardly and downwardly, over which external surface the open end of the flexible bag can be extended, and means surrounding said external surface of said ring member for holding the flexible bag tightly to said external surface of said ring member.

20. The bag holder for supporting an open-ended bag of flexible material in position for filling as recited in claim 21 in which said external surface slopes outwardly and downwardly at approximately a 15° angle to the vertical.

21. The bag holder for supporting an open-ended bag of flexible material in position for filling as recited in claim 19 in which each of said segments has a pair of curved sides, with a first curved side being shorter than the second curved side, said first curved side of each segment having an enlarged edge, whereby upon said segments being releasably joined together into a ring member, said first curved sides of said segments form an enlarged peripheral portion extending substantially continuously around said ring member, against which tension-applying means can abut, in order to tightly grip the open edge of the flexible bag.

22. The bag holder for supporting an open-ended bag of flexible material in position for filling as recited in claim 21 in which said tension-applying means involves a cord in which a tension spring is utilized.

23. The bag holder for supporting an open-ended bag of flexible material in position for filling as recited in claim 21 in which said tension-applying means involves a cord attached to a self-locking tensioning bar, said tensioning bar having a pair of offset cord-receiving holes, said tensioning bar being rotatable approximately 90° by a user at such time as said cord is to be placed in tension.

24. The bag holder for supporting an open-ended bag of flexible material in position for filling as recited in claim 19 in which said joinder means involves a first end of each segment having a tang, and a second end of each segment having a tang-receiving slot, with said tangs and slots, when interfitted together, causing said segments to form a sturdy ring member presenting the external surface sloping outwardly and downwardly.

25. The bag holder for supporting an open-ended bag of flexible material in position for filling as recited in claim 24 in which said tang and tang-receiving slots are disposed on the sides of said segments away from said external surface that slopes outwardly and downwardly, thereby preventing a thin plastic bag used with said bag holder being torn by contact with a tang member.

26. The bag holder for supporting an open-ended bag of flexible material in position for filling as recited in claim 24 in which a spaced pair of holes are utilized in the immediate vicinity of said tangs, and a spaced pair of studs are utilized in the immediate vicinity of said tang-receiving slots, with the spacing of said pair of holes and the spacing of said pair of studs being substantially identical, whereby said studs and said holes may be locked together after the tangs and slots have been interfitted.

27. The bag holder for supporting an open-ended bag of flexible material in position for filling as recited in claim 24 in which a leg supporting means is affixed on said second curved side of each of said segments.

28. The bag holder for supporting an open-ended bag of flexible material in position for filling as recited in claim 27 in which said leg supporting means protrudes downwardly in order to receive the open end of one of said legs.

29. The bag holder for supporting an open-ended bag of flexible material in position for filling as recited in claim 27 in which said leg supporting means involves an outward bulge in approximately a mid portion of each second curved side of each segment, with the upper end of a leg being received in each outward bulge.

30. The bag holder for supporting an open-ended bag of flexible material in position for filling as recited in claim 27 in which said leg supporting means includes a hole provided in approximately a mid portion of the second curved side of each segment, and the upper end of each leg has a mounting hole as well as being slotted so as to be insertable upon said second curved side of the respective segment, the hole in the segment being in a 90° relationship to the slotted upper end of the respective leg, and securing means passing through the hole in the second curved side of each segment when the hole in the respective leg has been aligned therewith, thus to prevent dislodgment of the respective leg from engagement with the respective second curved side.

31. The bag holder for supporting an open-ended bag of flexible material in position for filling as recited in claim 21 in which each leg supporting means, by virtue of being mounted on a surface that slopes outwardly and downwardly, causes the respective leg to extend outwardly from the vertical centerline of the bag holder, thus to increase the stability of the bag holder.

* * * * *